US008234787B2

(12) United States Patent
Sugawara

(10) Patent No.: US 8,234,787 B2
(45) Date of Patent: Aug. 7, 2012

(54) METHOD OF MANUFACTURING A LIQUID EJECTING HEAD

(75) Inventor: Satoshi Sugawara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/070,954

(22) Filed: Mar. 24, 2011

(65) Prior Publication Data

US 2011/0168316 A1 Jul. 14, 2011

Related U.S. Application Data

(62) Division of application No. 12/190,783, filed on Aug. 13, 2008, now abandoned.

(30) Foreign Application Priority Data

Aug. 17, 2007 (JP) ..... 2007-212654

(51) Int. Cl.
*B21D 53/76* (2006.01)

(52) U.S. Cl. ..... 29/890.1; 29/830; 29/831; 29/832; 29/846; 29/852

(58) Field of Classification Search ..... 29/890.1, 29/852, 832, 830, 831, 846, 847; 347/44, 347/47, 54, 68, 70–71; 216/27
See application file for complete search history.

(56) References Cited

U.S. PATENT DOCUMENTS

| | | | | |
|---|---|---|---|---|
| 5,872,583 | A * | 2/1999 | Yamamoto et al. | 347/70 |
| 6,554,406 | B1 | 4/2003 | Ohno et al. | |
| 6,584,687 | B1 * | 7/2003 | Yamamoto et al. | 29/890.1 |
| 7,140,554 | B2 * | 11/2006 | Chang | 239/102.2 |

FOREIGN PATENT DOCUMENTS

| | | |
|---|---|---|
| JP | 2003-062991 | 3/2003 |
| JP | 2003-311952 | 11/2003 |
| JP | 2006-224424 | 8/2006 |

* cited by examiner

*Primary Examiner* — Derris Banks
*Assistant Examiner* — Tai Nguyen
(74) *Attorney, Agent, or Firm* — Maschoff Gilmore & Israelsen

(57) ABSTRACT

A first film adhesive between actuator units and a supply port plate, a second film adhesive between a reservoir plate and the supply port plate, and a third film adhesive between the reservoir plate and a nozzle plate are each provided with round holes having an equal size and formed in correspondence to the locations of nozzle communication ports. Thanks to the round holes having the equal size one another, irregularity in capacities of spaces formed by layers of the first film adhesive, the second adhesive, and the third film adhesive are reduced, thereby reducing a difference of passage resistance caused in the nozzle communication ports. Accordingly, it is possible to realize a printing head capable of reducing irregularity in an amount of ejected ink and a speed of ink drops between nozzles.

7 Claims, 6 Drawing Sheets

METHOD OF MANUFACTURING A LIQUID EJECTING HEAD

CROSS REFERENCES TO RELATED APPLICATIONS

This application is a divisional of U.S. patent application Ser. No. 12/190,783, filed Aug. 13, 2008, which claims priority to Japanese Patent Application No. 2007-212654, filed Aug. 17, 2007. Both of the foregoing patent applications are incorporated herein by reference.

BACKGROUND OF THE INVENTION

The present invention relates to a liquid ejecting head and a method of manufacturing the same.

DESCRIPTION OF THE RELATED ART

An example of a liquid ejecting head includes an ink jet printing head mounted in an ink jet printing apparatus.

An ink jet printing head ejects ink from nozzle orifices formed in a nozzle plate by using vibration of a piezoelectric vibrator, for example. In addition, there is known a liquid ejecting head in which nozzle communication ports which are ink passages formed from actuators each including a piezoelectric vibrator to nozzle orifices are laminated in passage formation plates.

JP-A-2006-224424, for example, discloses a liquid ejecting head in which a nozzle plate, an ink storage chamber formation plate as a passage formation plate, a supply port formation plate, and an actuator are adhered with film adhesives.

Moreover, JP-A-2003-62991, for example, discloses a liquid ejecting head in which openings as nozzle communication ports in a lamination structure are formed in a passage formation plate.

An operation of adhering the passage formation plates and the actuators is performed by matching the passage formation plates and film adhesives and applying heat or pressure. At this time, holes are formed in the film adhesive in correspondence to the openings as the nozzle communication ports in the adhering operation so that the openings as the nozzle communication ports formed in the passage formation plate are not blocked by the adhesive.

The shape of the holes formed in the film adhesive is deformed due to the applied heat and pressure. In a manufacture process, a deformation degree is different in every hole when the heat and pressure are applied in an irregular manner. In this case, since the film adhesive has a thickness, a capacity of a space formed by the holes of the film adhesive may become irregular in every nozzle orifice. When the volume of the nozzle communication port is irregular, passage resistance may become different in every nozzle orifice. Therefore, an amount of ejected ink and an ejection speed may vary in every ink opening.

SUMMARY OF THE INVENTION

Accordingly, it is an object of the present invention to provide a liquid ejecting head having a configuration and applied examples described below.

The liquid ejecting head includes: an actuator unit which includes a pressure generating chamber; a nozzle plate in which a plurality of orifices are formed; and a supply port plate which is provided between the pressure generating chamber and the nozzle plate and in which a plurality of openings for forming nozzle communication ports communicating from the actuator to the nozzle orifices are formed. The actuator and the supply port plate are adhered by a first film adhesive, the first film adhesive is provided with a plurality of round holes in correspondence to the locations of the openings, and the sizes of the round holes formed in the first film adhesive are equal to each other.

Features and an object of the invention are apparent from description of the specification with reference to the accompanying drawings.

BRIEF DESCRIPTION OF THE DRAWINGS

For more understanding of the invention and the advantages, the following description and the accompanying drawings are referred.

DESCRIPTION OF THE PREFERRED EMBODIMENTS

Figure 1:
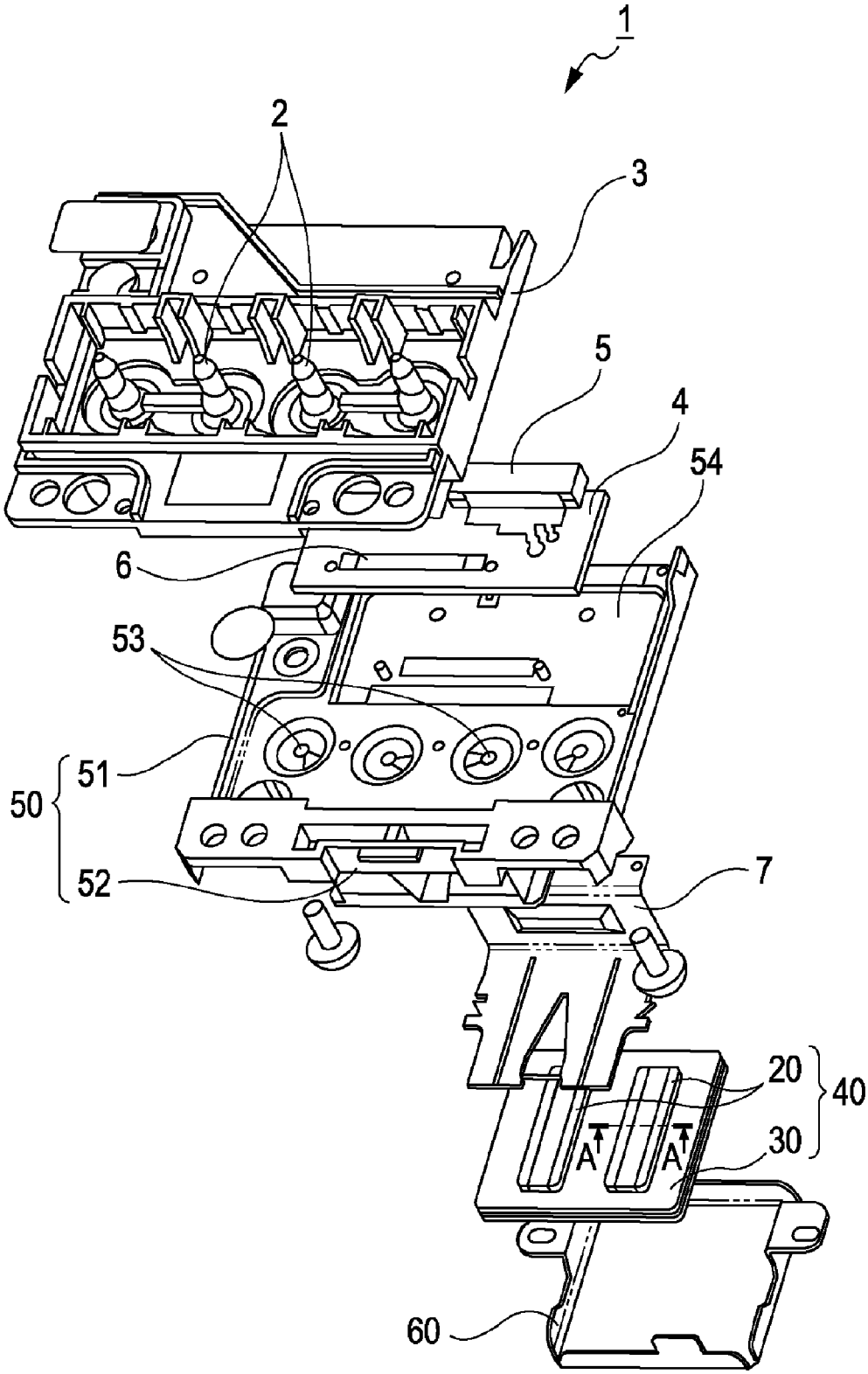
FIG. 1 is an exploded perspective view of a printing head according to an embodiment.

Aspects described blow are apparent from the description of the specification and the description of the accompanying drawings.

According an aspect of the invention, there is provided a liquid ejecting head including: an actuator unit which includes a pressure generating chamber; a nozzle plate in which a plurality of orifices are formed; and a supply port plate which is provided between the pressure generating chamber and the nozzle plate and in which a plurality of openings for forming nozzle communication ports communicating from the actuator to the nozzle orifices are formed. The actuator and the supply port plate are adhered by a first film adhesive, the first film adhesive is provided with a plurality of round holes in correspondence to the locations of the openings, and the sizes of the round holes formed in the first film adhesive are equal to each other.

According to this applied example, the first film adhesive between the actuator units and the supply port plate is provided with the round holes having the equal size and formed in correspondence to the locations of the nozzle communication ports. Thanks to the round holes having the equal size one another, irregularity in a capacity of a space formed by the layer of the first film adhesive is reduced, thereby reducing passage resistance of the nozzle communication ports. Accordingly, it is possible to realize the liquid ejecting head capable of reducing the irregularity in an amount of ejected liquid and a speed of liquid droplets.

The liquid ejecting head may further include a reservoir plate which is provided between the supply port plate and the nozzle plate and in which a plurality of openings for forming the nozzle communication ports are formed. The reservoir plate and the nozzle plate are adhered by a second film adhesive and the reservoir plate and the supply port plate are adhered by a third film adhesive. In addition, the second film adhesive and the third film adhesive are each provided with a plurality of round holes in correspondence to the locations of the openings and the sizes of the round holes formed in the second film adhesive and the third film adhesive are equal to each other.

According to this applied example, the second film adhesive and the third film adhesive are each provided with the round holes having the equal size one another and formed in correspondence to the locations of the nozzle communication ports. Thanks to the round holes having the equal size one another, the irregularity in a capacity of a space formed by the layer of the second film adhesive is reduced, thereby reducing passage resistance of the nozzle communication ports. Accordingly, it is possible to realize the liquid ejecting head capable of reducing the irregularity in the amount of ejected liquid and the speed of liquid droplets.

In the liquid ejecting head having the above-described configuration, a diameter of the round holes may be larger than a diameter of the openings.

According to this applied example, the round holes each formed in the first film adhesive, the second film adhesive, and the third film adhesive are larger than the openings. Accordingly, it is possible to realize the liquid ejecting head capable of suppressing an increase in the passage resistance of the nozzle communication ports thanks to the protrusion of the first film adhesive, the second film adhesive, and the third film adhesive toward the inside of the nozzle communication ports.

According to another aspect of the invention, there is provided a method of manufacturing a liquid ejecting head. The method includes: a first compressing step of forming nozzle communication ports from an actuator to nozzle orifices and heat-compressing one surface of a supply port plate provided with supply port plate openings for forming the nozzle communication ports and a first film adhesive provided with a plurality of round holes having an equal size and formed in correspondence to the locations of the supply port plate openings so as to match the locations of the supply port plate openings with the locations of the round holes of the first film adhesive; and a second compressing step of heat-compressing the supply port plate compressed with the first film adhesive and the actuator through the first film adhesive.

According to this applied example, the first film adhesive provided with the round holes having the equal size is used before the first compressing step. Therefore, the round holes formed in the first film adhesive are deformed uniformly while maintaining the round shape thereof, even when this film adhesive is contracted and expanded to be deformed due to the heat-compressing. Accordingly, since the irregularity of the capacity of the space formed by the layer of the first film adhesive is reduced, the difference of the passage resistance between the nozzle communication ports is reduced. As a result, it is possible to realize the liquid ejecting head capable of reducing the irregularity in the amount of ejected liquid and the speed of liquid droplets.

In the method of manufacturing the liquid ejecting head, a diameter of the round holes formed in the first film adhesive may be larger than a diameter of the supply port plate openings.

According to this applied example, the round holes formed in the first film adhesive are larger than the openings. Accordingly, it is possible to realize the liquid ejecting head capable of suppressing the increase in the passage resistance of the nozzle communication ports thanks to the protrusion of the first film adhesive toward the inside of the nozzle communication ports.

In the method of manufacturing the liquid ejecting head, the round holes after the second compressing step may be round and the size of the round holes after the second compressing step is smaller than that of the round holes before the second compressing step.

According to this applied example, the round shape of the round holes is maintained even after the second compressing step and the size of the round holes decreases. Accordingly, it is possible to realize the liquid ejecting head capable of further achieving the above-described advantages, since the influence of the capacity of the space formed by the layer of the first film adhesive is reduced.

In the method of manufacturing the liquid ejecting head, the compressing may be performed so that the size of the holes after the first compressing step is the same as that of the round holes after the second compressing step.

According to this applied example, the sizes of the round holes are equal to each other even after the first compressing step. Accordingly, it is possible to realize the liquid ejecting head capable of further achieving the above-described advantages, since the influence of the capacity of the space formed by the layer of the first film adhesive is reduced.

The method of manufacturing the liquid ejecting head may further include: a third compressing step of heat-compressing a nozzle plate provided with the nozzle orifices and a second film adhesive provided with a plurality of round holes having an equal size and formed in correspondence to the locations of the nozzle orifices so as to match the locations of the nozzle orifices and the locations of the round holes formed in the second film adhesive; a fourth compressing step of heat-compressing a reservoir plate provided with reservoir plate openings for forming the nozzle communication ports and a third film adhesive provided with a plurality of round holes having an equal size and formed in correspondence to the locations of the reservoir plate openings so as to match the reservoir plat openings and the round holes formed in the third film adhesive; and a fifth compressing step of superimposing the nozzle plate, the second film adhesive, the reservoir plate, the third film adhesive, the supply port plate, the first film adhesive, and the actuators in this order so that the holes form the nozzle communication port to perform heat-compressing.

According to this applied example, the second film adhesive provided with the round holes with the equal size is used before the third compressing step and the third film adhesive provided with the round holes having the equal size is used before the fourth compressing step. Therefore, the round holes formed in the second film adhesive and the round holes formed in the third film adhesive are deformed uniformly while maintaining the round shapes thereof, even when this film adhesive is contracted and expanded to be deformed due to the heat-compressing. Accordingly, since the irregularity of the capacities of the spaces formed by the layers of the second film adhesive and the third film adhesive are reduced, the difference of the passage resistance between the nozzle communication ports is reduced. As a result, it is possible to realize the liquid ejecting head capable of reducing the irregularity in the amount of ejected liquid and the speed of liquid droplets.

In the method of manufacturing the liquid ejecting head, the diameter of the round holes formed in the second film adhesive and the diameter of the third film adhesive may be larger than the diameter of the reservoir plate openings and the nozzle orifices.

According to this applied example, the round holes each formed in the second film adhesive and the third film adhesive are larger than the openings. Accordingly, it is possible to realize the method of manufacturing the liquid ejecting head capable of suppressing the increase in the passage resistance of the nozzle communication ports thanks to the protrusion of the second film adhesive and the third film adhesive toward the inside of the nozzle communication ports.

In the method of manufacturing the liquid ejecting head, the round holes after the fifth compressing step may be round and the size of the round holes after the fifth compressing process is smaller than that of the round holes before the fifth compressing step.

According to this applied example, since the sizes of the round holes are equal to each other even after the fifth compressing step, the influence of the capacities of the spaces formed by the layer of the first film adhesive, the second film adhesive, and the third film adhesive is reduced. Accordingly, it is possible to realize the method of manufacturing the liquid ejecting head capable of further achieving the above-described advantages.

In the method of manufacturing the liquid ejecting head, the size of the round holes after the fourth compressing step may be the same as that of the round holes after the fifth compressing step.

According to this applied example, the sizes of the round holes are equal to each other even after the first compressing step. Accordingly, it is possible to realize method of manufacturing the liquid ejecting head capable of further achieving the above-described advantages, since the influence of the capacities of the spaces formed by the layers of the first film adhesive, the second film adhesive, and the third film adhesive is reduced.

Hereinafter, a preferred embodiment of the invention will be described with reference to the drawings. The embodiment described below is just one example of the invention and all constituent elements described below are not essential constituent elements of the invention.

Hereinafter, an embodiment will be described with reference to the drawings.

FIG. 1 is an exploded perspective view illustrating a printing head 1 according to the embodiment.

Hereinafter, as a liquid ejecting head, an ink jet printing head (hereinafter, referred to as a printing head 1) which is mounted in an ink jet printing apparatus (which is one of a liquid ejecting apparatus and referred to as a printer below) and is capable of ejecting four types of ink) will be exemplified.

In FIG. 1, the printing head 1 includes in a head case 50 a supply needle unit 3 which is provided with a plurality of ink supply needles 2 introducing ink stored in an ink cartridge (not shown) to the inside of the printing head 1 and a head unit 40 which is provided with actuators 20 and a passage unit 30.

In the printing head 1, a metal cover 60 protecting the head unit 40 is attached to the front end (an opposite side of a joint surface of the supply needle unit 3) of the head case 50.

The supply needle unit 3 is a member which is made of a synthetic resin and in which the ink supply needles 2 are transversely arranged in a head main scanning direction (which is a direction perpendicular to a nozzle row). A front end of each of the ink supply needles 2 arranged in the supply needle unit 3 has a sharp conical shape to be easily inserted into the ink cartridge.

The front end is provided with a plurality of introduction holes, so that the ink stored in the ink cartridge is introduced through the introduction holes. In addition, the total four ink supply needles 2 corresponding to the four types of ink are arranged in the supply needle unit 3 so that the front ends of the ink supply needles protrude upward.

The head case 50 is a member which includes a base portion 51 to which the supply needle unit 3 and a wiring board 4 are attached; and a case portion 52 which has a shape of a hollow box extending from the bottom of the base portion 51 downward so that the head unit 40 is attached to an opening surface of a case portion.

In this embodiment, the head case 50 and the supply needle unit 3 are made of a synthetic resin such as a PPE (Poly Phenylene Ether) resin. In the base portion 51 of the head case 50, upper openings 53 of convergent passages (not shown) supplying ink to the head unit 40 are arranged at the locations corresponding to the ink supply needles 2 of the supply needle unit 3. In addition, a board arrangement portion 54 for arrangement of the wiring board 4 is formed in the base portion 51.

The wiring board 4 includes a connector 5. A wiring cable (not shown) such as a FFC (Flexible Flat Cable) from the main body of the printer is mounted in the connector 5. In addition, the wiring board 4 is provided with a connection terminal 6. A film-shaped flexible cable 7 such as a TCP (Tape Carrier Package) is electrically connected to the connection terminal 6. The wiring board 4 receives a driving signal from the main body of the printer through the FFC and supplies the driving signal to the actuator units 20 through the flexible cable 7.

Figure 2:
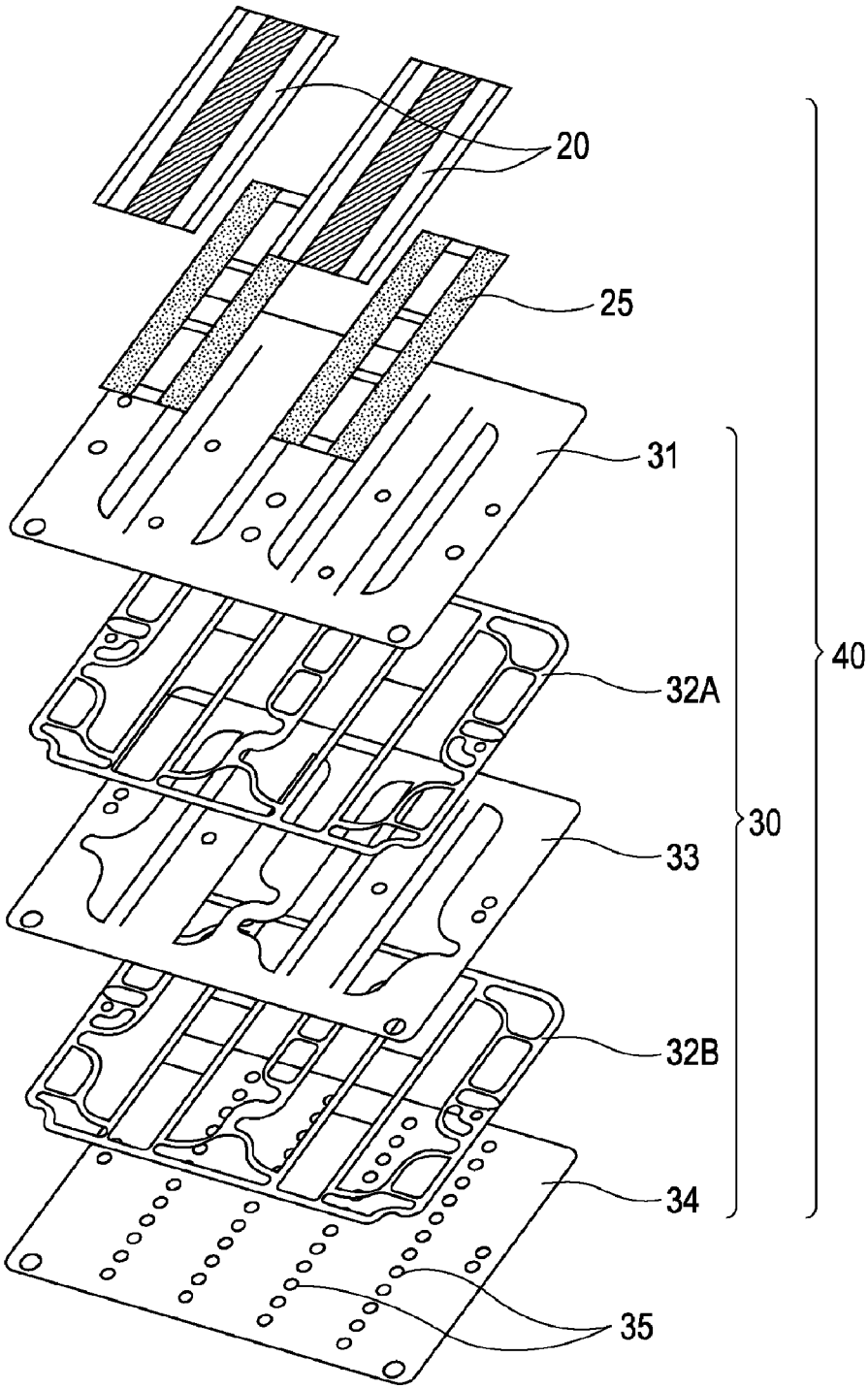
FIG. 2 is an exploded perspective view of a head unit.

FIG. 2 is an exploded perspective view illustrating the head unit 40.

The head unit 40 includes the actuator units 20 and the passage unit 30. The actuator units 20 and the passage unit 30 are attached to each other by a first film adhesive 25.

The passage unit 30 includes a supply port plate 31 as a passage forming plate, a second film adhesive 32A, a reservoir plate 33, a third film adhesive 32B, and a nozzle plate 34, which are laminated in this order.

The supply port plate 31 and the reservoir plate 33 are prepared by performing a press process or an etching process on a plate made of a metal material such as stainless steel.

In the nozzle plate 34, a plurality of nozzle orifices 35 are arranged in a pitch corresponding to a dot formation density in the form of rows. In this embodiment, the plurality (four) of rows (nozzle rows) of the nozzle orifices 35 are arranged in the head main scanning direction. Moreover, the nozzle plate 34 is arranged opposite the joint surface of the actuator units 20 in the passage unit 30.

The nozzle plate 34 is also a member which forms the passage unit 30 and is formed of the same material as that of the supply port plate 31 and the reservoir plate 33.

The metal cover 60 illustrated in FIG. 1 protects the nozzle plate 34 and also has a function of adjusting a potential to a ground potential.

Figure 3:
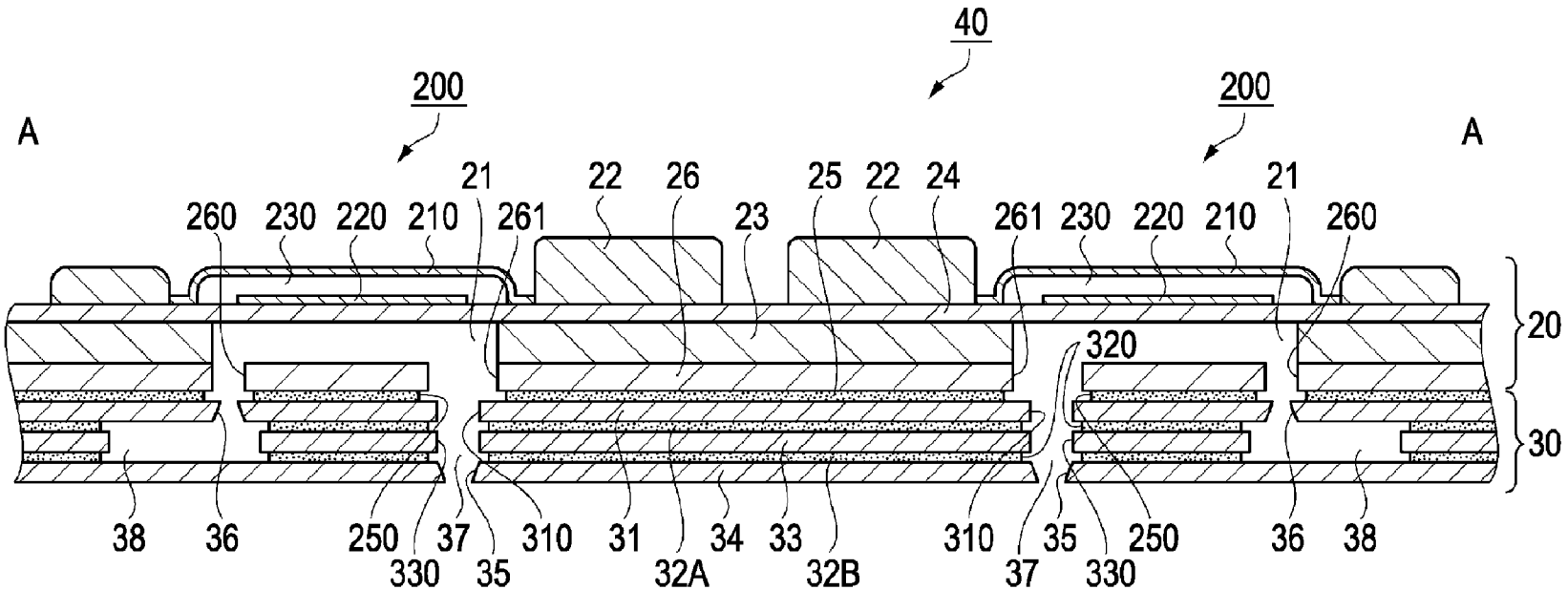
FIG. 3 is a sectional view of the head unit taken along a line A-A in FIG. 1.

FIG. 3 is a sectional view the head unit 40 taken along a line A-A of illustrated in FIG. 1.

The head unit 40 illustrated in FIG. 1 is integrally formed by superimposing two actuator units 20 and the passage unit 30. The two actuator units 20 are arranged in parallel in the head main scanning direction.

FIG. 3 shows a partial section view of a portion including one actuator unit 20.

Each of the actuator units 20 includes pressure chambers 21 which allow an inside liquid to be ejected through the nozzle orifices 35 by variation in pressure. Two piezoelectric vibrators 200 which are arranged in correspondence to the pressure chambers 21 and deformed with the driving signal supplied through driving terminals 22 to cause the pressure of the liquid within the pressure chamber 21 to vary are arranged in the main scanning direction. The pressure chambers 21 and the piezoelectric vibrators 200 are provided in correspondence to the nozzles in a nozzle row direction. The actuators 20 each have a narrow long shape along the nozzle rows in the nozzle row direction. One actuator unit 20 allows the liquid to be ejected from two nozzle rows. As for the piezoelectric vibrator, one piezoelectric vibrator may be provided in one nozzle row. That is, the piezoelectric vibrators are formed in succession so as to extend over the plurality of pressure chambers 21.

The actuator unit 20 is formed by laminating a pressure chamber plate 23 provided with openings which form the pressure chambers 21, a vibrator plate 24 mounted with the piezoelectric vibrators 200 and partitioning parts of the pressure chambers 21, and a communication port plate 26 provided with supply-side communication ports 260 and openings 261 which are nozzle communication ports 37. The pressure plate 23, the vibrator plate 24, and the communication port plate 26 are made of ceramics such as alumina or zirconium oxide and are integrated by a calcinations process. Of course, the invention is not limited to this material.

The pressure chambers 21 are members which are formed to have a narrow long hollow portion in a direction perpendicular to the nozzle row, and the plurality of pressure chamber are formed in correspondence to the nozzle orifices 35. One end of each pressure chamber 21 communicates with the reservoirs 38 through the supply-side communication port 260 and the ink supply port 36. The other end of each pressure chamber 21 opposite the supply communication port 260 communicates with the nozzle orifice 35 through the nozzle communication port 37. A part of the pressure chamber 21 is partitioned by the vibrator plate 24.

In this embodiment, the piezoelectric vibrator 200 is a bend mode piezoelectric vibrator which carries out bending vibration in accordance with an electric field applied to the piezoelectric vibrator 200 operating as a pressure generating element.

The piezoelectric vibrator 200 includes a driving electrode 210, a common electrode 220, and a piezoelectric body layer 230. The piezoelectric body layer 230 is interposed between the driving electrode 210 and the common electrode 220.

The piezoelectric vibrators 200 are formed on the surface of the vibrator plate 24 opposite the pressure chambers 21. That is, the piezoelectric vibrators 200 are arranged in a row in the nozzle row in correspondence to the pressure chambers 21. However, the invention is not limited thereto, but the piezoelectric vibrators may be formed in succession to extend over the plurality of pressure chambers 21. Each of the piezoelectric vibrators 200 is not limited to the configuration which includes one piezoelectric body layer 230, one driving electrode 210, and one common electrode 220. The piezoelectric vibrator 200 may be a lamination piezoelectric vibrator which includes a plurality of piezoelectric body layers, a plurality of driving electrodes, and a plurality of common electrodes.

The driving terminals 22 are electrically connected to the driving electrodes 210 of the piezoelectric vibrators 200. The common electrodes 220 are electrically connected to a common ground terminal through a common trunk electrode (not shown). Here, the driving terminals 22 are formed in an area between the rows of the two piezoelectric vibrators 200 and two rows of the driving terminals 22 are formed in correspondence to the piezoelectric vibrators 200.

The passage unit 30 includes the supply port plate 31 provided with support port plate openings 310, which are parts of the ink supply ports 36 functioning as orifices and the nozzle communication ports 37, a reservoir plate 33 provided with reservoir plate openings 330, which are parts of the reservoirs 38 (common liquid chamber) supplied with the ink from the supply needle needles 2 and the nozzle communication ports 37, and the nozzle plate 34.

The passage unit 30 is formed by providing the nozzle plate 34 on one surface of the reservoir plate 33 and the supply port plate 31 on the other surface thereof and by adhering the second film adhesive 32A and the third film adhesive 32B between theses plates, respectively. In the passage unit 30, there are formed the nozzle communication ports 37 which are ink passages formed from the reservoirs 38 to the nozzle orifices 35.

The actuator units 20 and the passage unit 30 are adhered by the first film adhesive 25. In the first film adhesive 25, a plurality of round holes 250 are formed in correspondence to the supply port plate openings 310. The diameters of the round holes 250 are larger than the diameters of the supply port plate openings 310 and have the equal size. At this time, the fact that the diameters of the round holes have the equal size means a range considered to be "equal" objectively in addition to irregularity based on the manufacture.

The second film adhesive 32A and the third film adhesive 32B are each provided with a plurality of round holes 320 in correspondence to the reservoir plate openings 330 and the nozzle orifices 35. The diameters of the round holes 320 are also larger than the diameters of the reservoir plate openings 330 and the nozzle orifices 35 and have an equal size. At this time, the fact that the diameters of the round holes have the equal size means a range considered to be "equal" objectively in addition to irregularity based on the manufacture.

Hereinafter, a method of manufacturing the printing head 1 and particularly a method of manufacturing the head unit 40 will be described in detail.

In FIG. 1, the printing head 1 is formed by assembling the head unit 40, the supply needle unit 3 formed with a synthetic resin, and the head case 50.

The wiring board 4 is mounted in the board arrange portion 54 of the head case 50, and the connector 5 and the flexible cable 7 are attached.

The outer edge of the head unit 40 is covered with the cover 60 and the head unit 40 is fixed to the head case 50 by pressing the cover 60 against the head case 50 and fixing the cover with screws.

Figure 4:
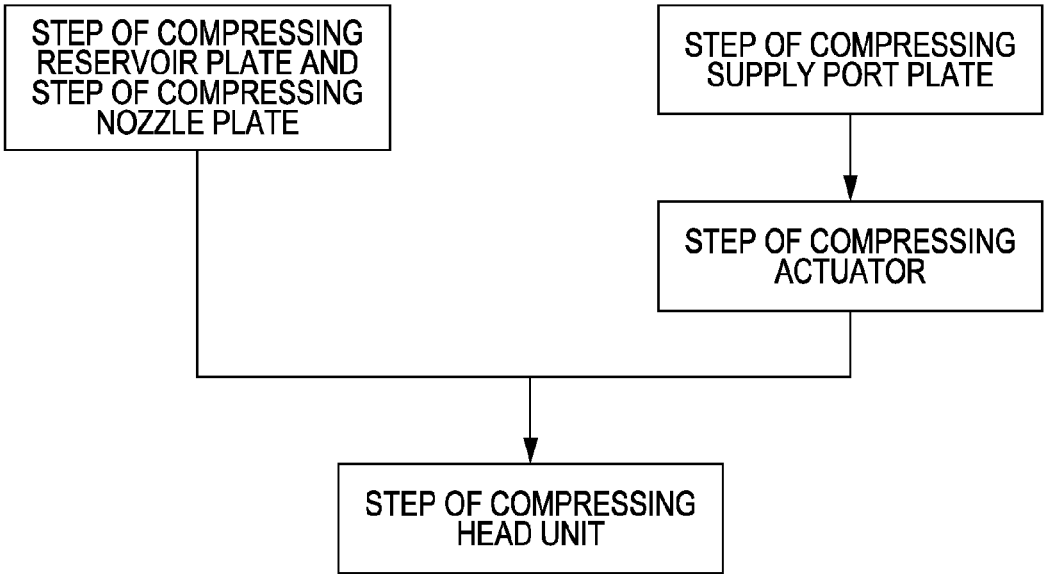
FIG. 4 is a flow diagram of a process of manufacturing the head unit.

FIG. 4 shows a flow diagram of the process of manufacturing the head unit 40.

The method of manufacturing the head unit 40 includes a step of compressing and attaching the second film adhesive 32A to the reservoir plate 33 and a step of compressing and attaching the third film adhesive 32B to the nozzle plate 34. Moreover, the method further includes a step of compressing and attaching the first film adhesive 25 to the supply port plate 31, a step of compressing against the actuator units 25 the supply port plate 31 to which the first film adhesive is compressed, and a head unit compressing step of compressing them.

Figure 5:
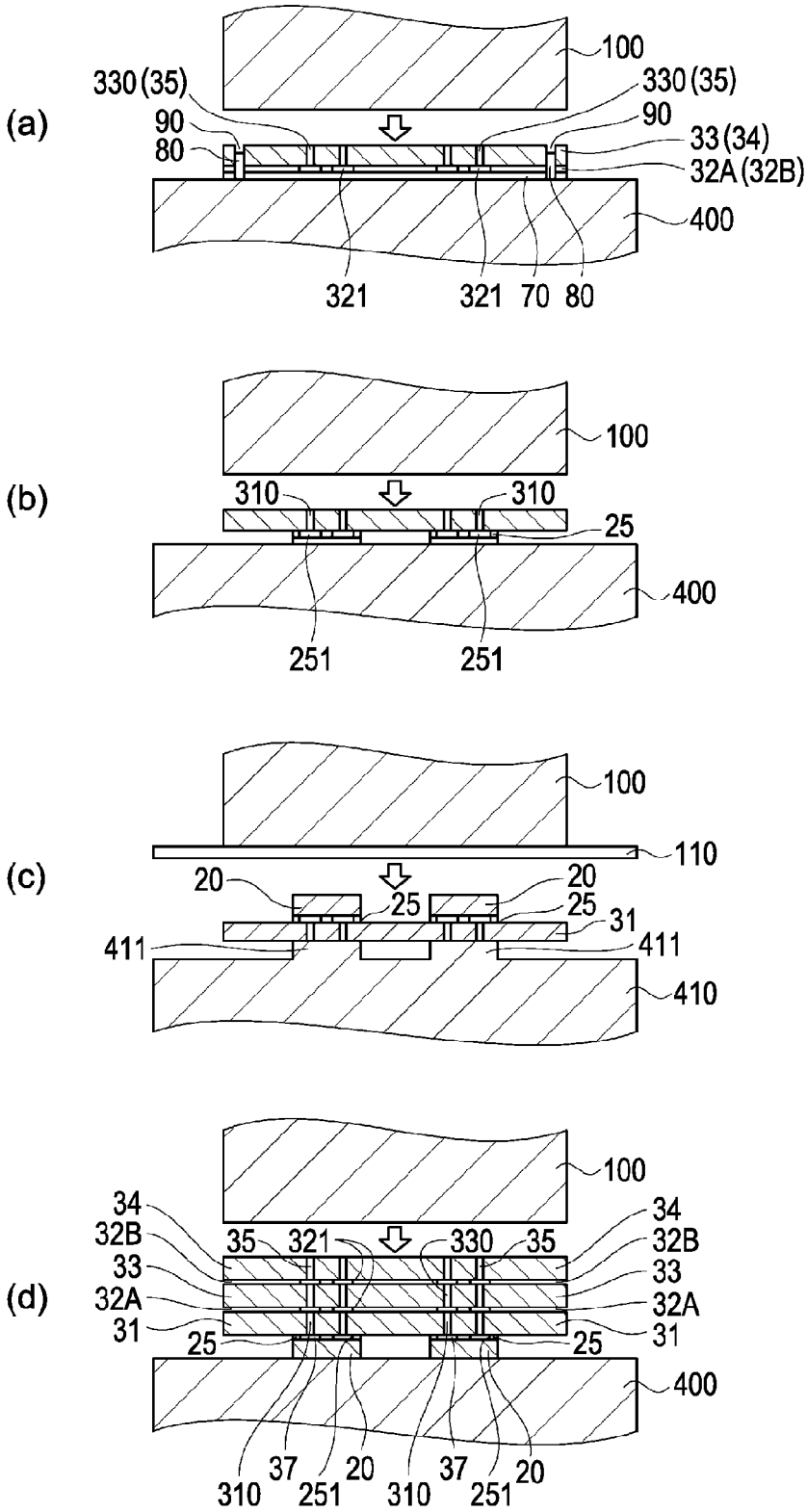
FIG. 5(*a*) is a schematic sectional view illustrating a reservoir plate compressing step and a nozzle plate compressing step, FIG. 5(*b*) is a schematic sectional view illustrating a supply port plate compressing step, and FIG. 5(*c*) is a schematic sectional view illustrating an actuator compressing step, and FIG. 5(*d*) is a schematic sectional view illustrating a head unit compressing step.

FIG. 5 shows a schematic perspective view of the compression operation.

FIG. 5(*a*) shows a schematic perspective view of the reservoir plate compressing step of the nozzle plate compressing step.

FIG. 5(*b*) shows a schematic perspective view of the supply port plate compressing step.

FIG. 5(*c*) shows a schematic perspective view of the actuator compressing step.

FIG. 5(*d*) shows a schematic perspective view of the head unit compressing step.

The compression operation includes steps of compressing the second film adhesive 32A and the third film adhesive 32B against the reservoir plate 33, the nozzle plate 34, and the supply port plate 31, respectively.

In FIG. 5(*a*), in the reservoir plate compressing step, the compression operation is performed by matching the locations of the reservoir plate openings 330 forming the nozzle communication ports 37 illustrated in FIG. 3 with the locations of the round holes 321 of the second film adhesive 32A, which is not subjected to the compression operation, formed in correspondence to reservoir plate the openings 330.

In the nozzle plate compressing step, the compression operation is performed by matching the locations of the nozzle orifices 35 illustrated in FIG. 3 with the locations of the round holes 321 of the third film adhesive 32B formed in correspondence to the nozzle orifices 35.

The diameters of the round holes 321 are larger than the diameters of the reservoir plate openings 330 and the diameters of the nozzle orifices 35.

The second film adhesive 32A and the third film adhesive 32B are provided on a film 70 made of polyethylene teraphthalate and the film 70 made of polyethylene teraphthalate is removed after the compression operation. After removing the film 70, the adhesives remains on the reservoir plate 33 and the nozzle plate 34.

Matching the locations of the round holes 321 with the reservoir plate openings 330 and the nozzle orifices 35 is achieved with guide pins 80 and holes 90 formed in the outer peripheries of the reservoir plate 33, the nozzle plate 34, the second film adhesive 32A, and the third film adhesive 32B.

The compression operation is performed by applying temperature and pressure between a heater 100 and a support table 400.

In FIG. 5(*b*), the supply port plate compressing step is performed by matching the locations of round holes 251 of the first film adhesive 25, which is not subjected to the compression operation, formed in correspondence to the supply port plate openings 310 forming the nozzle communication ports 37 illustrated in FIG. 3. A condition of the compression operation is the same as that of the reservoir plate compressing step and the nozzle plate compressing step.

The diameters of the round holes 251 of the first film adhesive 25 are larger than the diameters of the supply port plate openings 310.

The first film adhesive 25, the second film adhesive 32A, and the third film adhesive 32B may be formed of a polyolefin-based or epoxy-based film adhesive, for example.

In FIG. 5(*c*), in the actuator compressing step, there is compressed the supply port plate 31 against which the first film adhesive 25 obtained from the steps of compressing the actuator units 20 and the supply port plate is compressed.

In a support table 410, two protrusion portions 411 are provided at the locations of the actuator units 20 so as to effectively apply pressure.

In FIG. 5(*d*), in the head unit compression step, the compression operation is performed by superimposing the reservoir plate 33 against which the second film adhesive 32A is compressed, the nozzle plate 34 against which the third film adhesive 32B is compressed, the compressed actuator units 20, and the supply port plate 31.

The superimposing is performed so that the second film adhesive 32A is interposed between the supply port plate 31 and the reservoir plate 33 and the third film adhesive 32B is interposed between the reservoir plate 33 and the nozzle plate 34.

When the superimposing is performed, the nozzle orifices 35, the supply port plate openings 310, the reservoir plate opening 330, the round holes 251, the round holes 321 form the nozzle communication ports 37.

Figure 6:
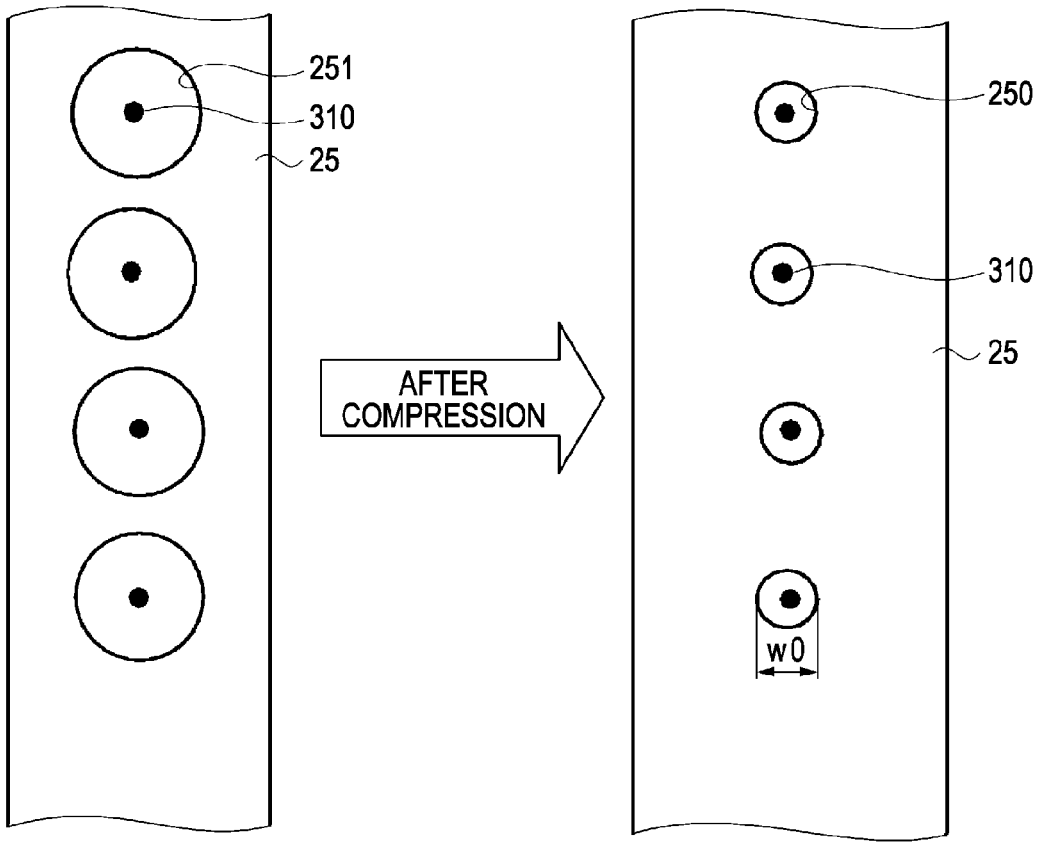
FIG. 6 is a diagram of states before and after compression of a round hole.

FIG. 6 shows the states before and after the compression operation on the round holes 250 formed in the first film adhesive 25 illustrated in FIG. 3 with respect to the supply port plate openings 310 formed in the supply port plate 31.

Hereinafter, the states before and after the compression operation on the round holes 250 will be described. The same result is obtained for the round holes 320.

In FIG. 6, the round holes 251 before the compression operation are illustrated and the round holes 250 deformed by applying the heat and pressure after the compression operation is illustrated.

The central locations of the round holes 251 and the supply port plate openings 310 are matched with each other to perform the compression operation.

The diameter of the round hole 251 is set to 0.17 mm.

According to the above-described embodiment, the following advantages are obtained.

The first film adhesive 25 between the actuator units 20 and the supply port plate 31 is provided with the round holes 250 having the equal size one another and in the locations in correspondence to the nozzle communication ports 37. Thanks to the round holes 250 having the equal size, irregularity of a capacitor of a space formed by the layer of the first film adhesive 25 can be reduced, thereby reducing a difference of passage resistance between the nozzle communication ports 37. Accordingly, it is possible to realize a printing head capable of reducing the irregularity of an amount of ejected liquid and a speed of liquid droplet, that is, the amount of ejected ink and the speed of ink droplet in this case between nozzles.

The second film adhesive 32A between the reservoir plate 33 and the supply port plate 31 and the third film adhesive 32B between the reservoir plate 33 and the nozzle plate 34 are each provided with the round holes 320 having the equal size one another and in the locations in correspondence to the nozzle communication ports 37. Thanks to the round holes 320 having the equal size, irregularity of capacitors of spaces formed by the layers of the second film adhesive 32A and the third film adhesive 32B can be reduced, thereby reducing the difference of the passage resistance between the nozzle communication ports 37. Accordingly, it is possible to realize a printing head 1 capable of reducing the irregularity of the amount of ejected liquid and the speed of liquid droplet, that is, the amount of ejected ink and the speed of ink droplet in this case between the nozzles.

The round holes 250 and 320 formed in the first film adhesive 25, the second film adhesive 32A, and the third film adhesive 32B are larger than the supply port plate openings 310, the reservoir plate openings 330, and the nozzle orifices 35, respectively. Accordingly, it is possible to realize the printing head 1 capable of suppressing an increase in the passage resistance of the nozzle communication ports 37 thanks to protrusion of the first film adhesive 25, the second film adhesive 32A, and the third film adhesive 32B toward the inside of the nozzle communication ports 37.

The first film adhesive 25 provided with the round holes 251 having the equal size one another is used before the supply port plate compressing step. Therefore, the round holes 251 formed in the first film adhesive 25 are uniformly deformed while maintaining the round shape, even when this film adhesive is contracted and expanded to be deformed by the heat-compressing. Therefore, thanks to the reduction in the irregularity of the capacity of the space formed by the layer of the first film adhesive 25, the difference of the passage resistance between the nozzle communication ports 37 can be reduced. Accordingly, it is possible to realize the printing head 1 capable of reducing the irregularity of the amount of ejected liquid and the speed of liquid droplet, that is, the amount of ejected ink and the speed of ink droplet in this case between the nozzles.

The round holes 250 formed in the first film adhesive is larger than the supply port plate openings 310. Accordingly, it is possible to realize the printing head 1 capable of suppressing the increase in the passage resistance of the nozzle communication ports 37 thanks to protrusion of the first film adhesive 25 toward the inside of the nozzle communication ports 37.

Since the original shape of the round holes 251 is maintained even when the actuator pressing step and the size thereof is reduced, the influence of the capacity of the space formed by the layer of the first film adhesive 25 can be reduced. Accordingly, it is possible to realize the method of manufacturing the printing head 1 capable of further achieving the above-described advantages.

Since the round holes 251 have the equal size even after the actuator compressing step, the influence of the capacity of the space formed by the layer of the first film adhesive 25 can be reduced. Accordingly, it is possible to realize the method of manufacturing the printing head 1 capable of further achieving the above-described advantages.

The second film adhesive 32A and the third film adhesive 32B each provided with the round holes 321 having the equal size one another are used before the reservoir plate compressing step and the nozzle plate compressing step. Therefore, the round holes 321 formed in the second film adhesive are uniformly deformed while maintaining the round shape even when this film adhesive is contracted and expanded to be deformed. Therefore, thanks to the reduction in the irregularity of the capacities of the spaces formed by the layers of the second film adhesive 32A and the third film adhesive 32B, the difference of the passage resistance between the nozzle communication ports 37 can be reduced. Accordingly, it is possible to realize the method of manufacturing the printing head 1 capable of reducing the irregularity of the amount of ejected liquid and the speed of liquid droplet, that is, the amount of ejected ink and the speed of ink droplet in this case between the nozzles.

The round holes 321 each formed in the second film adhesive 32A and the third film adhesive 32B are larger than the reservoir plate openings 330 and the nozzle orifices 35. Accordingly, it is possible to realize the method of manufacturing the printing head 1 capable of suppressing the increase in the passage resistance of the nozzle communication ports 37 thanks to the protrusion of the second film adhesive 32A and the third film adhesive 32B toward the inside of the nozzle communication ports 37.

Since the original shapes of the round holes 250 and 320 are maintained even after the actuator pressing step and the sizes thereof are reduced, the influence of the capacities of the spaces formed by the layers of the first film adhesive 25, the second film adhesive 32A, and the third film adhesive 32B can be reduced. Accordingly, it is possible to realize the method of manufacturing the method of manufacturing the printing head 1 capable of further achieving the above-described advantages.

Since the round holes 250 and 320 have the equal size even after the actuator compressing step, the influence of the capacities of the spaces formed by the layers of the first film adhesive 25, the second film adhesive 32A, and the third film adhesive 32B can be reduced. Accordingly, it is possible to realize the method of manufacturing the printing head 1 capable of further achieving the above-described advantages.

Since the round holes 251 and 321 formed in the first film adhesive 25, the second film adhesive 32A, and the third film adhesive 32B have the same round shape, a punching operation can be performed. Accordingly, cost can be reduced.

The invention is not limited to the above-described embodiment, but may be modified with various forms without departing the gist of the invention other than the above-described embodiment.

For example, another plate may be added in addition to the passage unit 30, the reservoir plate 33, the nozzle plate 34, and the supply port plate 31.

What is claimed is:

1. A method of manufacturing a liquid ejecting head, comprising:

a first compressing step of forming nozzle communication ports from an actuator to nozzle orifices and heat-compressing one surface of a supply port plate provided with supply port plate openings for forming the nozzle communication ports and a first film adhesive provided with a plurality of round holes having an equal size and formed in correspondence to the locations of the supply port plate openings so as to match the locations of the supply port plate openings with the locations of the round holes of the first film adhesive;

a second compressing step of heat-compressing the supply port plate compressed with the first film adhesive and the actuator through the first film adhesive;

a third compressing step of heat-compressing a nozzle plate provided with the nozzle orifices and a second film adhesive provided with a plurality of round holes having an equal size and formed in correspondence to the locations of the nozzle orifices so as to match the locations of the nozzle orifices and the locations of the round holes formed in the second film adhesive;

a fourth compressing step of heat-compressing a reservoir plate provided with reservoir plate openings for forming the nozzle communication ports and a third film adhesive provided with a plurality of round holes having an equal size and formed in correspondence to the locations of the reservoir plate openings so as to match the reservoir plat openings and the round holes formed in the third film adhesive; and a fifth compressing step of superimposing the nozzle plate, the second film adhesive, the reservoir plate, the third film adhesive, the supply port plate, the first film adhesive, and the actuators in this order so that the holes form the nozzle communication port to perform heat-compressing.

2. The method according to claim 1, wherein a diameter of the round holes formed in the first film adhesive is larger than a diameter of the supply port plate openings.

3. The method according to claim 1, wherein the round holes after the second compressing step are round and the size of the round holes after the second compressing step is smaller than that of the round holes before the second compressing step.

4. The method according to claim 1, wherein the compressing is performed so that the size of the holes after the first compressing step is the same as that of the round holes after the second compressing step.

5. The method according to claim 1, wherein the diameter of the round holes formed in the second film adhesive and the diameter of the third film adhesive are larger than the diameter of the reservoir plate openings and the nozzle orifices.

6. The method according to claim 1, wherein the round holes after the fifth compressing step are round and the size of the round holes after the fifth compressing process is smaller than that of the round holes before the fifth compressing step.

7. The method according to claim 1, wherein the size of the round holes after the fourth compressing step is the same as that of the round holes after the fifth compressing step.

* * * * *